US009685262B2

(12) United States Patent
Johansson

(10) Patent No.: US 9,685,262 B2
(45) Date of Patent: Jun. 20, 2017

(54) SURGE ARRESTER MODULE AND SURGE ARRESTER

(71) Applicant: ABB Schweiz AG, Baden (CH)

(72) Inventor: Daniel Johansson, Grängesberg (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/311,454

(22) PCT Filed: Mar. 26, 2015

(86) PCT No.: PCT/EP2015/056508

§ 371 (c)(1),
(2) Date: Nov. 15, 2016

(87) PCT Pub. No.: WO2015/185237

PCT Pub. Date: Dec. 10, 2015

(65) Prior Publication Data

US 2017/0084368 A1 Mar. 23, 2017

(30) Foreign Application Priority Data

Jun. 4, 2014 (EP) ..... 14171190

(51) Int. Cl.
*H01C 7/10* (2006.01)
*H01C 7/12* (2006.01)
(Continued)

(52) U.S. Cl.
CPC ..... *H01C 7/12* (2013.01); *H01C 1/14* (2013.01); *H01T 4/16* (2013.01)

(58) Field of Classification Search
CPC ..... H01C 7/12; H01C 1/14
(Continued)

(56) References Cited

U.S. PATENT DOCUMENTS 5,191,503 A 3/1993 Kawamura et al.
5,291,366 A 3/1994 Giese et al.
(Continued)

FOREIGN PATENT DOCUMENTS

EP 1936639 B1 7/2009
EP 2953141 A1 12/2015
(Continued)

OTHER PUBLICATIONS

European Search Report Application No. EP 14 17 1190 completed: Nov. 7, 2014; Mailing Date: Nov. 27, 2014 4 pages.
(Continued)

*Primary Examiner* — Kyung Lee
(74) *Attorney, Agent, or Firm* — Whitmyer IP Group LLC

(57) ABSTRACT

A surge arrester module including: first and second end electrodes; and a stack of cylindrical elements including at least one varistor block. The first end electrode includes a first part and a second part. A connecting element is provided between the first end electrode parts in order to keep them electrically connected to each other if a gap is formed between them. At least one clamping member is connected to the second end electrode and to the first part of the first end electrode in order to press them towards each other in the axial direction. The clamping member or at least one other clamping member is connected to the second end electrode and to the second part of the first end electrode in order to press them towards each other in the axial direction.

20 Claims, 5 Drawing Sheets

(51) Int. Cl.
*H01C 1/14* (2006.01)
*H01T 4/16* (2006.01)

(58) Field of Classification Search
USPC ..... 338/21
See application file for complete search history.

(56) References Cited

U.S. PATENT DOCUMENTS

| | | | | |
|---|---|---|---|---|
| 5,517,382 | A | 5/1996 | Leupp et al. | |
| 5,608,597 | A * | 3/1997 | Holmstrom | H01C 7/12 361/126 |
| 5,912,611 | A | 6/1999 | Berggren et al. | |
| 5,936,826 | A * | 8/1999 | Schmidt | H01C 7/12 361/117 |
| 5,942,968 | A * | 8/1999 | Schmidt | H01C 7/12 338/101 |
| 6,777,614 | B1 | 8/2004 | Suenwoldt | |
| 8,107,206 | B2 * | 1/2012 | Johansson | H01C 7/12 361/117 |
| 2005/0105238 | A1 | 5/2005 | Schmidt et al. | |

FOREIGN PATENT DOCUMENTS

| | | | |
|---|---|---|---|
| WO | 2004097858 | A1 | 11/2004 |
| WO | 2012098250 | A1 | 7/2012 |

OTHER PUBLICATIONS

International Search Report & Written Opinion of the International Searching Authority Application No. PCT/EP2015/056508 completed: May 29, 2015; Mailing Date: Jun. 10, 2015 11 pages.

* cited by examiner

SURGE ARRESTER MODULE AND SURGE ARRESTER

TECHNICAL FIELD

The present invention relates to a surge arrester module with a first and second end electrode and a stack of cylindrical elements including a varistor block. The invention also relates to a surge arrester comprising two or more such surge arrester modules.

BACKGROUND

Different types of surge arresters are today used in switchgears in order to protect power network equipment against incoming overvoltages. A surge arrester is connected between a live wire and ground and may comprise one or more gapless surge arrester modules with varistor blocks of metal oxide, for instance zinc oxide, arranged between two end electrodes. In a varistor block of metal oxide, the electrical resistance is high at low voltages but low at high voltages. When the voltage level in the live wire exceeds a critical value, the surge arrester will allow the electric current to be conducted to ground through the varistor blocks, whereby the overvoltage is reduced.

When the normal operating voltage in the live wire is so high that a single varistor block is not capable of resisting the operating voltage, several varistor blocks are connected in series in a stack between the end electrodes of the surge arrester module. To carry large currents through a stack of varistor blocks and to give the surge arrester module a good stability, a sufficient contact pressure must be maintained between the varistor blocks. The required contact pressure between the varistor blocks may be achieved by means of elongated clamping members of electrically insulating material which are connected to the end electrodes and prestressed so as to press the end electrodes towards each other in the axial direction of the surge arrester module and thereby achieve contact pressure between the varistor blocks. The clamping members may for instance have the form of endless loops, as shown in U.S. Pat. No. 5,517,382 A, U.S. Pat. No. 5,912,611 A and WO2012098250 A1, or rod-like elements, as shown in U.S. Pat. No. 5,291,366 A and U.S. Pat. No. 6,777,614 A.

A surge arrester to be used in a power network of high system voltage is often formed by one or more groups of surge arrester modules of the above-mentioned type, wherein each group comprises two or more surge arrester modules mounted in parallel with each other between a lower support member and an upper support member. The support members may for instance have the form of plates or beams. In order to adapt the surge arrester to the system voltage, two or more such groups of surge arrester modules may be stacked on top of each other and fixed to each other with the surge arrester modules in one group connected in series with the surge arrester modules of each adjacent group.

If a multi-module surge arrester of the above-mentioned type is placed on a foundation and consequently supported from below, some of the surge arrester modules may be subjected to an axial tensile force when other surge arrester modules, due to uneven load distribution on the surge arrester, are axially compressed. Such an uneven load distribution on the surge arrester may for instance occur due to uneven ice formation on the surge arrester, heavy wind or earthquakes. Heavy connecting cables hanging obliquely from the top of the surge arrester may also cause an uneven load distribution on the surge arrester, particularly when the cables are trembling due to overvoltages. In the worst case, the axial tensile force on a surge arrester module may become so high that the prestress force of the clamping members is lost, which in its turn would result in an unacceptable loss of contact pressure between the varistor blocks in the surge arrester module.

In order to avoid high tensile forces in the surge arrester modules of a multi-module surge arrester of the above-mentioned type and thereby prevent a loss of contact pressure between varistor blocks of the surge arrester modules, the surge arrester is normally suspended through the uppermost group of surge arrester modules, for instance in a bus bar. However, it is not always possible or desirable to use a suspended surge arrester and there is therefore a need for an alternative solution to the above-mentioned problem, to thereby make it possible to place a multi-module surge arrester of the above-mentioned type on a foundation without running the risk of losing contact pressure between varistor blocks of the surge arrester modules due to uneven load distribution on the surge arrester. Besides, high tensile forces may also occur in a suspended surge arrester and cause loss of contact pressure between varistor blocks of a suspended surge arrester if the suspended surge arrester is big and heavy and/or supports additional equipment or long cables.

SUMMARY

The object of the present invention is to achieve a new and favourable solution to the above-mentioned problem.

This object is achieved by the invention.

The surge arrester module of the present invention comprises first and second end electrodes, a stack of cylindrical elements, including at least one varistor block, arranged between the first and second end electrodes, and an outer casing of electrically insulating material, wherein the surge arrester module is characterized in;

that the first end electrode comprises a first part of electrically conductive material and an adjacent second part of electrically conductive material, the first part being located between the second part and said stack and being provided with a first contact surface configured to abut against a corresponding second contact surface of the second part;

that an electrical connecting element is provided between the first and second parts of the first end electrode, the electrical connecting element being configured to keep these parts electrically connected to each other in case of the formation of a gap between said first and second contact surfaces;

that at least one clamping member of electrically insulating material is connected to the second end electrode and to the first part of the first end electrode and configured to press the second end electrode and the first part of the first end electrode towards each other in the axial direction of the surge arrester module to thereby achieve contact pressure between the cylindrical elements of said stack and clamp the stack between the second end electrode and the first part of the first end electrode; and that said at least one clamping member or at least one other clamping member of electrically insulating material is connected to the second end electrode and to the second part of the first end electrode and configured to press the second end electrode and the second part of the first end electrode towards each other in the axial direction of the surge arrester module to thereby achieve contact pressure between said first and second contact surfaces.

The surge arrester module is constructed in such a manner that the effects of an axial tensile force on the surge arrester module will be concentrated to the interface between the first and second parts of the first end electrode, and the contact pressure between the elements in the stack between the second end electrode and the first part of the first end electrode is always maintained, no matter how high the tensile force might be. By introducing an electrical connecting element that secures the electrical connection between the first and second parts of the first end electrode, it can be secured that the surge arrester module will continue to be capable of functioning properly even in a situation when the surge arrester module is subjected to such a high axial tensile force that a gap is formed between the first and second parts of the first end electrode. Except for a modification of the end electrodes, the surge arrester module of the present invention may be constructed in a conventional manner. Thus, the present invention can be implemented in a rather simple and cost-efficient manner.

According to an embodiment of the invention, the electrical connecting element is flexible or elastic and may thereby adapt itself to possible displacements between the first and second parts of the first end electrode.

According to another embodiment of the invention, the electrical connecting element is accommodated in a cavity formed by a recess in said first contact surface and/or a recess in said second contact surface. In this way, the electrical connecting element is hidden inside the first end electrode and thereby efficiently protected from the environment and also prevented from interfering with other components of the surge arrester module.

According to another embodiment of the invention, the electrical connecting element comprises a compression spring, which at a first end abuts against a surface on the first part of the first end electrode and at an opposite second end abuts against a surface on the second part of the first end electrode. Hereby, the electrical connecting element may in a simple manner adapt itself to possible displacements between the first and second parts of the first end electrode.

According to another embodiment of the invention, said at least one clamping member has the form of an endless loop and extends in a meander-like pattern around the stack with:

at least two first meander-like loops, each of which extending from a shoulder on the second end electrode, over a shoulder on the first part of the first end electrode and back to another shoulder on the second end electrode, and at least two second meander-like loops, each of which extending from a shoulder on the second end electrode, over a shoulder on the second part of the first end electrode and back to a shoulder on the second end electrode.

If the surge arrester module according to this embodiment is subjected to an axial tensile force striving to pull the end electrodes a part, the tensile force will act on said second meander-like loops of the clamping member and these second meander-like loops will in their turn exert a tensile force on said first meander-like loops of the clamping member, which will result in increased contact pressure between the varistor blocks and the other elements in the stack between the second end electrode and the first part of the first end electrode. The tensile force on said second meander-like loops of the clamping member may cause the formation of a gap between the first and second parts of the first end electrode. However, the above-mentioned electrical connecting element will make sure that the electrical connection between the first and second parts of the first end electrode is maintained in such a situation.

Another embodiment of the invention is characterized in:

that one or more first clamping members of electrically insulating material are connected to the second end electrode and to the first part of the first end electrode and configured to press the second end electrode and the first part of the first end electrode towards each other in the axial direction of the surge arrester module to thereby achieve contact pressure between the cylindrical elements of said stack and clamp the stack between the second end electrode and the first part of the first end electrode; and that one or more second clamping members of electrically insulating material are connected to the second end electrode and to the second part of the first end electrode and configured to press the second end electrode and the second part of the first end electrode towards each other in the axial direction of the surge arrester module to thereby achieve contact pressure between said first and second contact surfaces.

If the surge arrester module according to this embodiment is subjected to an axial tensile force striving to pull the end electrodes a part, the tensile force will act only on the above-mentioned second clamping members between the second end electrode and the second part of the first end electrode and not on the above-mentioned first clamping members between the second end electrode and the first part of the first end electrode. Thus, the varistor blocks and the other elements in the stack between the second end electrode and the first part of the first end electrode will remain essentially unaffected by the tensile force. If the tensile force is higher than the prestress force of the second clamping members between the second end electrode and the second part of the first end electrode, a gap will be formed between the first and second parts of the first end electrode. However, the above-mentioned electrical connecting element will make sure that the electrical connection between the first and second parts of the first end electrode is maintained in such a situation.

Further advantages as well as advantageous features of the surge arrester module according to the invention will appear from the following description and the dependent claims.

The invention also relates to a surge arrester, which comprises two or more surge arrester modules of the above-mentioned type vertically mounted in parallel with each other between a lower support member and an upper support member.

Further advantages as well as advantageous features of the surge arrester according to the invention will appear from the following description and the dependent claims.

BRIEF DESCRIPTION OF THE DRAWINGS

The invention will in the following be more closely described by means of embodiment examples, with reference to the enclosed drawings. In the drawings.

DETAILED DESCRIPTION

Figure 1:
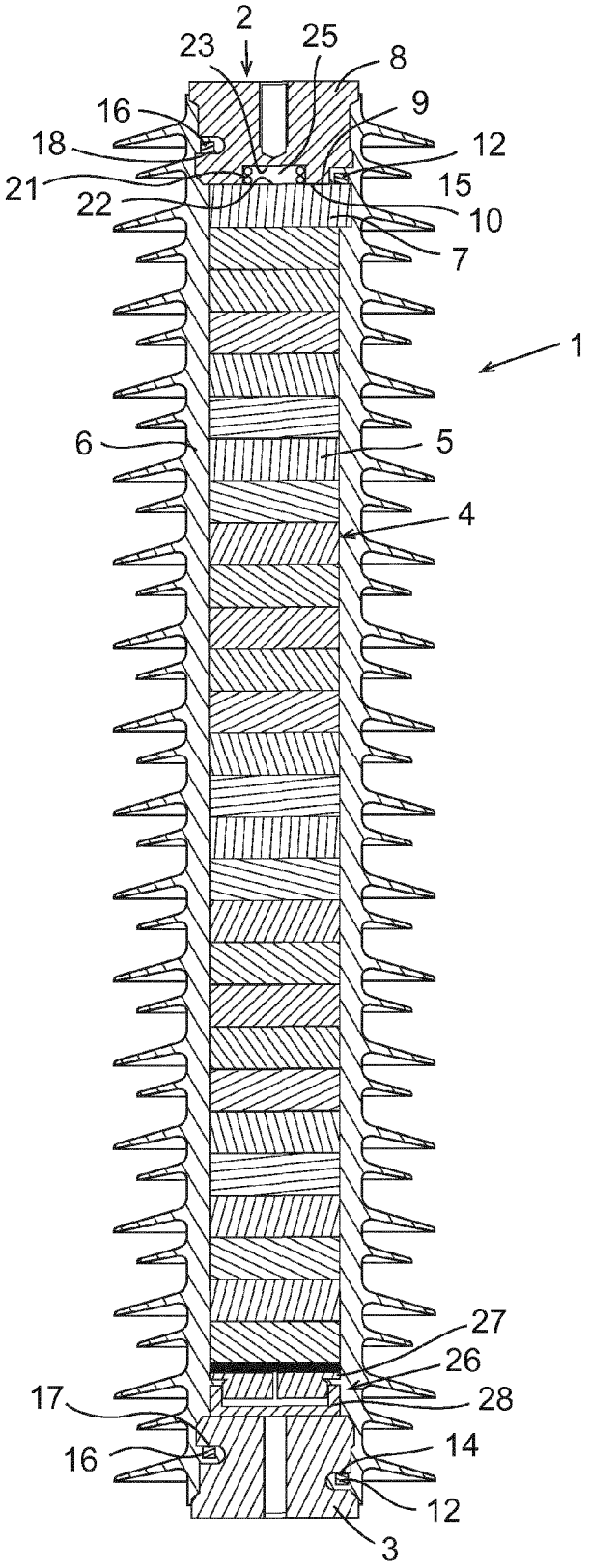
FIG. 1 is a vertical section through a surge arrester module according to an embodiment of the present invention.

FIG. 1 schematically illustrates a surge arrester module 1 according to an embodiment of the present invention. The surge arrester module 1 comprises:

- a first end electrode 2 and a second end electrode 3 spaced apart in the axial direction of the surge arrester module 1;
- a stack 4 of cylindrical elements 5 arranged between the first and second end electrodes 2, 3; and
- an outer casing 6 of electrically insulating material.

The cylindrical elements 5 are preferably circularly cylindrical and are stacked on top of each other. In the illustrated embodiment, the stack 4 comprises several series connected cylindrical element 5 in the form of varistor blocks of nonlinear resistance material, preferably zinc oxide. The stack 4 may also comprise one or more cylindrical spacer elements (not shown) of electrically conductive material, such as aluminium, steel or any other suitable metal. In the illustrated embodiment, the stack comprises twenty-seven cylindrical elements 5 in the form of varistor blocks. However, the stack 4 may comprise a greater or lesser number of varistor blocks.

One of the end electrodes 2, 3 is to be electrically connected to a live wire or another surge arrester module, whereas the other end electrode is to be electrically connected to ground or another surge arrester module. When the voltage applied to the surge arrester module 1 exceeds a critical value, a current can flow between the end electrodes 2, 3 via the varistor blocks in the stack 4.

The first end electrode 2 comprises a first part 7 of electrically conductive material and an adjacent second part 8 of electrically conductive material. The first part 7 is located between the second part 8 and the stack 4 and is provided with a first contact surface 9 configured to abut against a corresponding second contact surface 10 of the second part 8. The contact surfaces 9, 10 are shaped to fit to each other while establishing a good electrical contact between the first and second parts 7, 8. In the illustrated embodiment, said contact surfaces 9, 10 are planar and extends perpendicularly to the longitudinal axis of the surge arrester module 1. However, the contact surfaces 9, 10 may have any other suitable shape, for instance conical. The second part 8 of the first end electrode 2 is to be electrically connected to a live wire, ground or another surge arrester module, and the second part 8 is in its turn electrically connected to the stack 4 via the first part 7 of the first end electrode 2.

The second end electrode 3 and the first and second parts 7, 8 of the first end electrode 2 are made of metal, preferably aluminium or steel.

Figure 3:
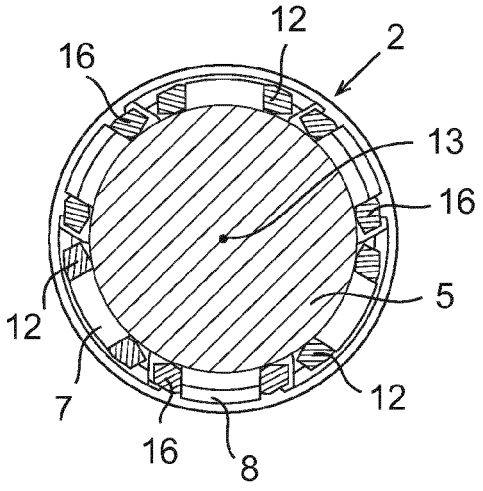
FIG. 3 is a cut according to the line III-Ill in FIG. 2.

One or more first clamping members 12 of electrically insulating material are connected to the second end electrode 3 and to the first part 7 of the first end electrode 2 and are configured to press the second end electrode 3 and the first part 7 of the first end electrode towards each other in the axial direction of the surge arrester module 1 to thereby achieve contact pressure between the cylindrical elements 5 of the stack 4 and clamp the stack 4 between the second end electrode 3 and the first part 7 of the first end electrode. The first clamping members 12 are rigid but capable of expanding somewhat in the axial direction. In the illustrated embodiment, the surge arrester module 1 is provided with three such first clamping members 12 in the form of endless loops evenly distributed about the centre axis 13 of the surge arrester module, as illustrated in FIG. 3. However, the surge arrester module 1 may comprise a greater or lesser number of first clamping members 12, including one single loop-shaped clamping member arranged in the manner described in WO2012098250 A1.

Each loop-shaped first clamping member 12 extends over a shoulder 14 on the second end electrode 3 and a shoulder 15 on the first part 7 of the first end electrode 2.

One or more second clamping members 16 of electrically insulating material are connected to the second end electrode 3 and to the second part 8 of the first end electrode 2 and are configured to press the second end electrode 3 and the second part 8 of the first end electrode towards each other in the axial direction of the surge arrester module 1 to thereby achieve contact pressure between the first contact surface 9 on the first part 7 of the first end electrode 2 and the corresponding second contact surface 10 on the second part 8 of the first end electrode 2. The second clamping members 16 are rigid but capable of expanding somewhat in the axial direction. In the illustrated embodiment, the surge arrester module 1 is provided with three such second clamping members 16 in the form of endless loops evenly distributed about the centre axis 13 of the surge arrester module, as illustrated in FIG. 3. However, the surge arrester module 1 may comprise a greater or lesser number of second clamping members 16, including one single loop-shaped clamping member arranged in the manner described in WO2012098250 A1.

Each loop-shaped second clamping member 16 extends over a shoulder 17 on the second end electrode 3 and a shoulder 18 on the second part 8 of the first end electrode 2.

Figure 5:
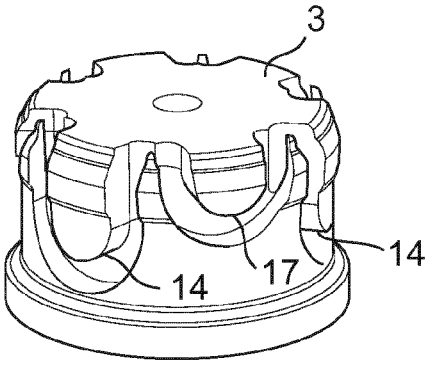
FIG. 5 is a perspective view of a second end electrode included in the surge arrester module of FIG. 1.

In the illustrated embodiment, the first clamping members 12 are of the same length as the second clamping members 16. To make it possible to use first and second clamping members 12, 16 of the same length, the shoulders 14 on the second end electrode for the first clamping members 12 are located closer to the outer end of the second end electrode 3 than the shoulders 17 on the second end electrode for the second clamping members 16 (FIG. 5), the axial distance between a pair of shoulders 14, 15 for a first clamping member 12 being the same as the axial distance between a pair of shoulders 17, 18 for a second clamping member 16.

As an alternative, the shoulders 14 on the second end electrode for the first clamping members 12 and the shoulders 17 on the second end electrode for the second clamping members 16 may all be located at the same distance from the outer end of the second end electrode 3. Hereby, the second end electrode 3 may be constructed with a shorter axial extension and thereby set space free for a longer stack 4 between the first and second end electrodes 2, 3.

The loop-shaped first and second clamping members 12, 16 are preferably formed of a wound, glass fiber reinforced strip embedded in a polymer matrix. Such a loop-shaped clamping member is formed in advance and then arranged on the shoulders upon assembly of the surge arrester module. A clamping member could alternatively be formed by a fiber being wound a plurality of turns between the shoulders during assembly. It would also be possible to use first and second clamping members in the form of rods as an alternative to endless loops.

Figure 4:
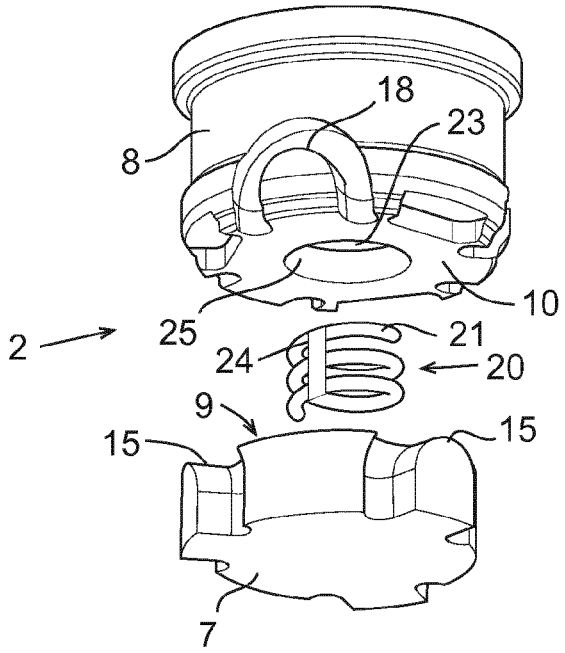
FIG. 4 is an exploded view of the parts of a first end electrode included in the surge arrester module of FIG. 1.

If the surge arrester module 1 is subjected to a high axial tensile force, a small gap may be formed between the first contact surface 9 on the first part 7 of the first end electrode 2 and the opposite second contact surface 10 on the second part 8 of the first end electrode. An electrical connecting element 20 (see FIG. 4) is provided between the first and second parts 7, 8 of the first end electrode 2, this electrical connecting element 20 being configured to keep the first and second parts 7, 8 of the first end electrode electrically connected to each other in case of the formation of a gap between said first and second contact surfaces 9, 10. The electrical connecting element 20 is preferably flexible or elastic. In the illustrated embodiment, the electrical connecting element 20 comprises a helical compression spring 21, which at a first end abuts against a first surface 22 on the first part 7 of the first end electrode 2 and at an opposite second end abuts against an opposite second surface 23 on the second part 8 of the first end electrode, and a flexible strip 24 of electrically conductive material, preferably copper. The strip 24 extends along the compression spring 21 and is at a first end clamped between the first end of the compression spring 21 and said first surface 22 and at the opposite second end clamped between the second end of the compression spring 21 and said second surface 23. In the illustrated embodiment, the electrical connecting element 20 is accommodated in a cavity 25 formed by a recess in said second contact surface 10. As an alternative, the electrical connecting element 20 may be accommodated in a cavity formed by a recess in said first contact surface 9 or in a cavity formed by a recess in said first contact surface 9 and an opposite recess in said second contact surface 10. The electrical connecting element 20 may also be formed by a flexible band of electrically conductive material, which at a first end is fixed to and electrically connected to the first part 7 of the first end electrode 2 and at the opposite second end is fixed to and electrically connected to the second part 8 of the first end electrode. As a further alternative, the electrical connecting element 20 may be formed by a pin of electrically conductive material which is fixed to the first or second part 7, 8 of the first end electrode 2 so as to project, in the axial direction of the surge arrester module 1, from the contact surface of this part towards the opposite contact surface of the other part, the pin being slidably received in and in electrical contact with a corresponding bore in the other part of the first end electrode 2.

Figure 2:
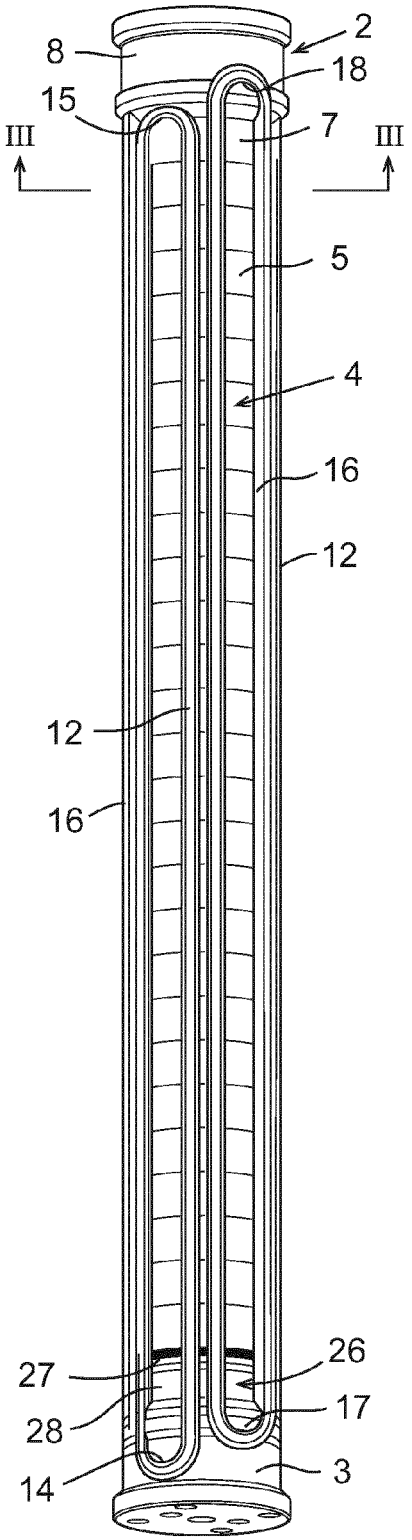
FIG. 2 is a perspective view of the surge arrester module of FIG. 1, as seen without the outer casing.

In the embodiment illustrated in FIGS. 1 and 2, the surge arrester module 1 comprises a combined length adjustment and pivot unit 26 of the type described in closer detail in EP1936639 B1, the unit 26 being very schematically shown in FIG. 1. This unit 26 is located between the stack 4 and the second end electrode 3 and comprises an upper part 27 and a lower part 28. These two parts 27, 28 are interconnected by means of corresponding threads on the upper and lower parts. By mutual rotation between the upper and lower parts 27, 28, the total length of the unit 26 can be adjusted to thereby increase the distance between the second end electrode 3 and the first end electrode 2 so that the first and second clamping members 12, 16 are prestressed to a desired extent when the surge arrester module 1 is assembled.

The outer casing 6 is of an elastic material, for instance silicone rubber or EPDM rubber, and surrounds all the components between the second end electrode 3 and the second part 8 of the first end electrode 2 and also the first and second clamping members 12, 16. The outer casing 6 also surrounds the second end electrode 3 and the second part 8 of the first end electrode 2, except the outer ends thereof. The outer casing 6 is preferably applied to the surge arrester module 1 by casting.

The casing 6 is with advantage provided with a bellows-like section (not shown) or the similar at the part of the casing located on the outside of the interface between the first and second parts 7, 8 of the first end electrode 2 to thereby make it easier for the casing 6 to stretch in the axial direction in case of the formation of a larger gap, for instance in the order of 1 cm, between the first and second parts 7, 8 of the first end electrode 2. As an alternative to such a bellows-like section, the casing could be formed of two separate casing portions which were allowed to move in relation to each other in case of the formation of such a gap. Preferably, one of the casing portions could be configured to cover any interspace formed between the casing portions when moved from each other. The portions could be telescopically arranged. Alternatively, an additional cover portion could be arranged to cover any interspace formed between the casing portions.

The first end electrode 2 is preferably arranged at the upper end of the surge arrester module 1 and the second end electrode 3 at the lower end of the surge arrester module 1, as illustrated in FIGS. 1 and 2.

Figure 7:
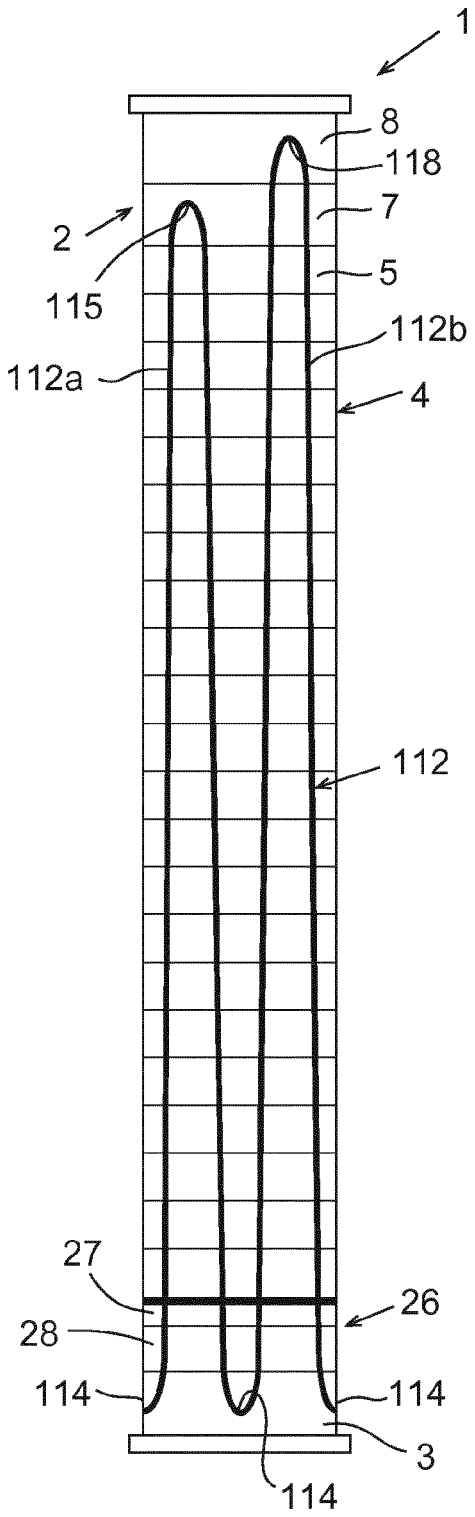
FIG. 7 is a schematic illustration of a surge arrester module according to another embodiment of the invention, as seen without the outer casing.

A surge arrester module 1 according to an alternative embodiment of the invention is schematically illustrated in FIG. 7. For the sake of clarity, the surge arrester module 1 is shown without the outer casing in FIG. 7. In this embodiment, the surge arrester module 1 comprises one single clamping member 112 in the form of an endless loop, which extends in a meander-like pattern around the stack 4 with:

- two first meander-like loops 112*a* arranged on opposite sides of the stack 4, each of which extending from a shoulder 114 (shoulders not shown in detail) on the second end electrode 3, over a shoulder 115 on the first part 7 of the first end electrode 2 and back to another shoulder 114 on the second end electrode 3, and
- two second meander-like loops 112*b* arranged on opposite sides of the stack 4, each of which extending from a shoulder 114 on the second end electrode 3, over a shoulder 118 on the second part 8 of the first end electrode 2 and back to a shoulder 114 on the second end electrode 3.

The first and second meander-like loops 112*a*, 112*b* are alternately arranged in the circumferential direction of the surge arrester module 1. In this case, the first meander-like loops 112*a* of the clamping member 112 are configured to press the second end electrode 3 and the first part 7 of the first end electrode towards each other in the axial direction of the surge arrester module 1 to thereby achieve contact pressure between the cylindrical elements 5 of the stack 4 and clamp the stack 4 between the second end electrode 3 and the first part 7 of the first end electrode, whereas the second meander-like loops 112*b* of the clamping member 112 are configured to press the second end electrode 3 and the second part 8 of the first end electrode towards each other in the axial direction of the surge arrester module 1 to thereby achieve contact pressure between the first contact surface 9 on the first part 7 of the first end electrode 2 and the corresponding second contact surface 10 on the second part 8 of the first end electrode 2. The clamping member 112 is of electrically insulating material and is rigid but capable of expanding somewhat in the axial direction. The clamping member 112 is preferably formed of a wound, glass fiber reinforced strip embedded in a polymer matrix. Except for the clamping member 112 and the arrangement of the shoulders 114, 115, 118 on the end electrodes 2, 3, the surge arrester module 1 illustrated in FIG. 7 corresponds to the surge arrester module illustrated in FIG. 1.

A multi-module surge arrester may be formed by one or more groups of surge arrester modules 1 of the above-mentioned types, wherein each group comprises two or more surge arrester modules 1 vertically mounted in parallel with each other between a lower first support member and an upper second support member located above the first support member, preferably with the second end electrode 3 of each surge arrester module 1 located at the lower end of the surge arrester module and with the first end electrode 2 of each surge arrester module 1 located at the upper end of the surge arrester module.

Figure 6:
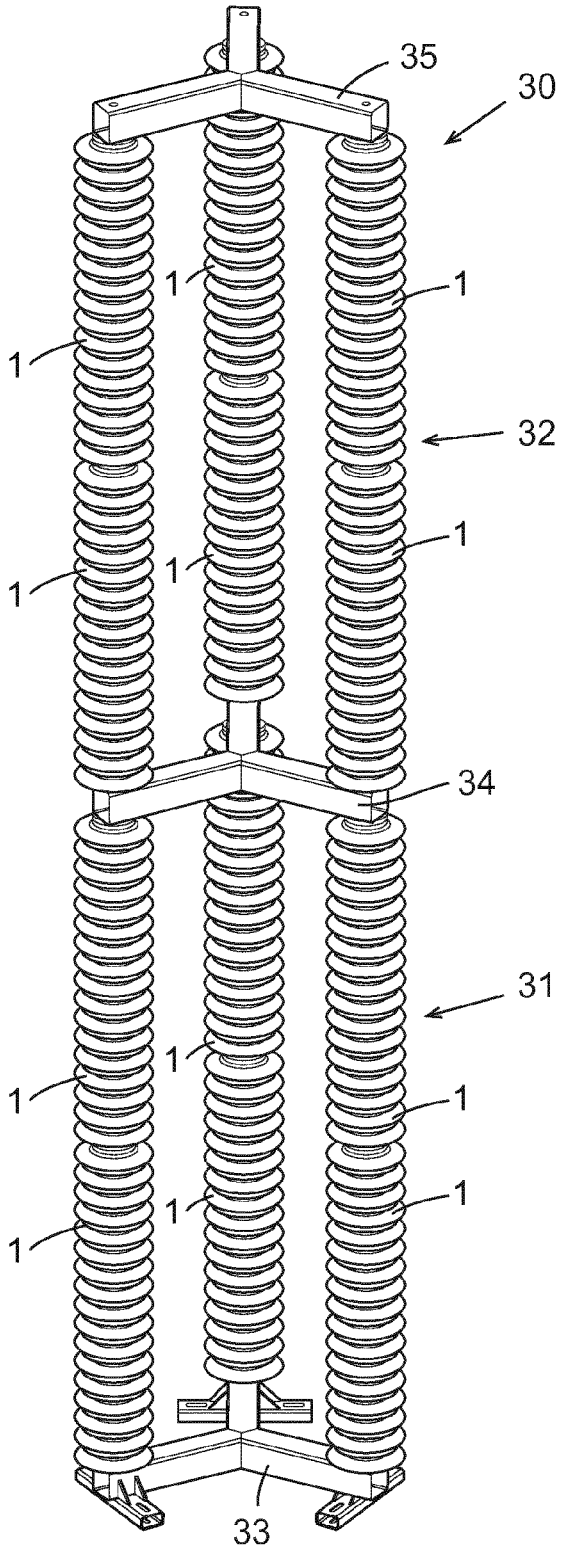
FIG. 6 is a perspective view of a surge arrester comprising twelve surge arrester modules of the type illustrated in FIG. 1.

A surge arrester 30 formed by two groups 31, 32 of surge arrester modules 1 is illustrated in FIG. 6. In the illustrated embodiment, each group 31, 32 comprises six surge arrester modules 1 vertically mounted two and two in pairs, with one surge arrester module 1 in each pair mounted vertically above and connected in series with the other surge arrester module 1 in the pair and with the pairs mounted in parallel with each other. The illustrated surge arrester 30 comprises a lower support member 33, through which the surge arrester 30 is to be mounted to a foundation, an intermediate support member 34 and an upper support member 35. The surge arrester modules 1 of the first group 31 are mounted between the lower support member 33 and the intermediate support member 34, preferably with the second end electrode 3 of each lower surge arrester module 1 in the group 31 fixed to the lower support member 33 and with the second part 8 of the first end electrode 2 of each upper surge arrester module 1 in the group 31 fixed to the intermediate support member 34. The surge arrester modules 1 of the second group 32 are mounted between the intermediate support member 34 and the upper support member 35, preferably with the second end electrode 3 of each lower surge arrester module 1 in the group 32 fixed to the intermediate support member 34 and with the second part 8 of the first end electrode 2 of each upper surge arrester module 1 in the group 32 fixed to the upper support member 35.

In the embodiment illustrated in FIG. 6, the support members 33, 34, 35 have the form of beams. However, support members in the form of plates could also be used. Furthermore, the number of surge arrester modules 1 mounted vertically above each other in each group, the number of surge arrester modules 1 mounted in parallel with each other in each group and the number of groups stacked on top of each other may differ from what is illustrated in FIG. 6.

The general idea underlying the present invention is to improve the prior art surge arrester modules, which comprise first and second end electrodes, a stack of varistor blocks and clamping means arranged to press the electrodes towards each other, by configuring the module such that the stack is sufficiently pressed together even if large forces pull the electrodes apart. The invention is of course not in any way restricted to the embodiments described above. On the contrary, many possibilities to modifications thereof will be apparent to a person with ordinary skill in the art without departing from the basic idea of the invention such as defined in the appended claims.

The invention claimed is:

1. A surge arrester module comprising:

a first end electrode and a second end electrode spaced apart in the axial direction of the surge arrester module;

a stack of cylindrical elements arranged between the first and second end electrodes, at least one of these cylindrical elements being a varistor block; and an outer casing of electrically insulating material, characterized in:

that the first end electrode comprises a first part of electrically conductive material and an adjacent second part of electrically conductive material, the first part being located between the second part and said stack and being provided with a first contact surface configured to abut against a corresponding second contact surface of the second part;

that an electrical connecting element is provided between the first and second parts of the first end electrode, the electrical connecting element being configured to keep these parts electrically connected to each other in case of the formation of a gap between said first and second contact surfaces;

that at least one clamping member of electrically insulating material is connected to the second end electrode and to the first part of the first end electrode and configured to press the second end electrode and the first part of the first end electrode towards each other in the axial direction of the surge arrester module to thereby achieve contact pressure between the cylindrical elements of said stack and clamp the stack between the second end electrode and the first part of the first end electrode; and that said at least one clamping member or at least one other clamping member of electrically insulating material is connected to the second end electrode and to the second part of the first end electrode and configured to press the second end electrode and the second part of the first end electrode towards each other in the axial direction of the surge arrester module to thereby achieve contact pressure between said first and second contact surfaces.

2. The surge arrester module according to claim 1, characterized in that the electrical connecting element is flexible or elastic.

3. The surge arrester module according to claim 2, characterized in that the electrical connecting element is accommodated in a cavity formed by a recess in said first contact surface and/or a recess in said second contact surface.

4. The surge arrester module according to claim 3, characterized in that the electrical connecting element comprises a compression spring, which at a first end abuts against a surface on the first part of the first end electrode and at an opposite second end abuts against a surface on the second part of the first end electrode.

5. The surge arrester module according to claim 2, characterized in that the electrical connecting element comprises a compression spring, which at a first end abuts against a surface on the first part of the first end electrode and at an opposite second end abuts against a surface on the second part of the first end electrode.

6. The surge arrester module according to claim 2, characterized in that said at least one clamping member has the form of an endless loop and extends in a meander-like pattern around the stack with:

at least two first meander-like loops, each of which extending from a shoulder on the second end electrode, over a shoulder on the first part of the first end electrode and back to another shoulder on the second end electrode, and at least two second meander-like loops, each of which extending from a shoulder on the second end electrode, over a shoulder on the second part of the first end electrode and back to a shoulder on the second end electrode.

7. The surge arrester module according to claim 2, characterized in:

that one or more first clamping members of electrically insulating material are connected to the second end electrode and to the first part of the first end electrode and configured to press the second end electrode and the first part of the first end electrode towards each other in the axial direction of the surge arrester module to thereby achieve contact pressure between the cylindrical elements of said stack and clamp the stack between the second end electrode and the first part of the first end electrode; and that one or more second clamping members of electrically insulating material are connected to the second end electrode and to the second part of the first end electrode and configured to press the second end electrode and the second part of the first end electrode towards each other in the axial direction of the surge arrester module to thereby achieve contact pressure between said first and second contact surfaces.

8. The surge arrester module according to claim 1, characterized in that said at least one clamping member has the form of an endless loop and extends in a meander-like pattern around the stack with:

at least two first meander-like loops, each of which extending from a shoulder on the second end electrode, over a shoulder on the first part of the first end electrode and back to another shoulder on the second end electrode, and at least two second meander-like loops, each of which extending from a shoulder on the second end electrode, over a shoulder on the second part of the first end electrode and back to a shoulder on the second end electrode.

9. The surge arrester module according to claim 8, characterized in that said first and second meander-like loops are alternately arranged in the circumferential direction of the surge arrester module.

10. The surge arrester module according to claim 1, characterized in:

that one or more first clamping members of electrically insulating material are connected to the second end electrode and to the first part of the first end electrode and configured to press the second end electrode and the first part of the first end electrode towards each other in the axial direction of the surge arrester module to thereby achieve contact pressure between the cylindrical elements of said stack and clamp the stack between the second end electrode and the first part of the first end electrode; and that one or more second clamping members of electrically insulating material are connected to the second end electrode and to the second part of the first end electrode and configured to press the second end electrode and the second part of the first end electrode towards each other in the axial direction of the surge arrester module to thereby achieve contact pressure between said first and second contact surfaces.

11. The surge arrester module according to claim 10, characterized in that the surge arrester module comprises two or more first clamping members, preferably three or more first clamping members, evenly distributed about the centre axis of the surge arrester module.

12. The surge arrester module according to claim 11, characterized in that the surge arrester module comprises two or more second clamping members, preferably three or more second clamping members, evenly distributed about the centre axis of the surge arrester module.

13. The surge arrester module according to claim 10, characterized in that the surge arrester module comprises two or more second clamping members, preferably three or more second clamping members, evenly distributed about the centre axis of the surge arrester module.

14. The surge arrester module according to claim 10, characterized in that each one of said first and second clamping members has the form of an endless loop.

15. The surge arrester module according to claim 14, characterized in that each first clamping member extends over a shoulder on the second end electrode and a shoulder on the first part of the first end electrode.

16. The surge arrester module according to claim 15, characterized in that each second clamping member extends over a shoulder on the second end electrode and a shoulder on the second part of the first end electrode.

17. The surge arrester module according to claim 14, characterized in that each second clamping member extends over a shoulder on the second end electrode and a shoulder on the second part of the first end electrode.

18. The surge arrester module according to claim 17, characterized in:

in that each first clamping member extends over a shoulder on the second end electrode and a shoulder on the first part of the first end electrode;

that the axial distance between a pair of shoulders for a first clamping member is the same as the axial distance between a pair of shoulders for a second clamping member; and that said first and second clamping members are of the same length.

19. A surge arrester, characterized in that the surge arrester comprises two or more surge arrester modules, each including:

a first end electrode and a second end electrode spaced apart in the axial direction of the surge arrester module;

a stack of cylindrical elements arranged between the first and second end electrodes, at least one of these cylindrical elements being a varistor block; and an outer casing of electrically insulating material, characterized in:

that the first end electrode comprises a first part of electrically conductive material and an adjacent second part of electrically conductive material, the first part being located between the second part and said stack and being provided with a first contact surface configured to abut against a corresponding second contact surface of the second part;

that an electrical connecting element is provided between the first and second parts of the first end electrode, the electrical connecting element being configured to keep these parts electrically connected to each other in case of the formation of a gap between said first and second contact surfaces;

that at least one clamping member of electrically insulating material is connected to the second end electrode and to the first part of the first end electrode and configured to press the second end electrode and the first part of the first end electrode towards each other in the axial direction of the surge arrester module to thereby achieve contact pressure between the cylindrical elements of said stack and clamp the stack between the second end electrode and the first part of the first end electrode;

that said at least one clamping member or at least one other clamping member of electrically insulating material is connected to the second end electrode and to the second part of the first end electrode and configured to press the second end electrode and the second part of the first end electrode towards each other in the axial direction of the surge arrester module to thereby achieve contact pressure between said first and second contact surfaces; and wherein the two or more arrester modules are vertically mounted in parallel with each other between a first support member and a second support member located above the first support member.

20. The surge arrester according to claim 19, characterized in that each one of said surge arrester modules is mounted with the first end electrode located at the upper end of the surge arrester module and with the second end electrode located at the lower end of the surge arrester module.

* * * * *